US006383038B2

(12) United States Patent
Murakami et al.

(10) Patent No.: US 6,383,038 B2
(45) Date of Patent: May 7, 2002

(54) CONNECTOR

(75) Inventors: Takao Murakami; Yoshitsugu Sawada, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/847,378

(22) Filed: May 3, 2001

(30) Foreign Application Priority Data

Jun. 13, 2000 (JP) ..... 2000-176608

(51) Int. Cl.[7] ..... H01R 11/22
(52) U.S. Cl. ..... 439/854; 439/721; 439/404
(58) Field of Search ..... 439/851, 852, 439/853, 854, 855, 401, 404, 405, 406, 721, 724, 722

(56) References Cited

U.S. PATENT DOCUMENTS 4,066,316 A * 1/1978 Rollings ..... 439/404
4,655,528 A * 4/1987 Groft ..... 439/404
5,057,026 A * 10/1991 Sawai et al. ..... 439/76.1
5,622,515 A * 4/1997 Hotea et al. ..... 439/398

FOREIGN PATENT DOCUMENTS

JP 4-42722 2/1992

* cited by examiner

*Primary Examiner*—Tulsidas Patel
(74) *Attorney, Agent, or Firm*—Armstrong, Westerman & Hattori, LLP

(57) ABSTRACT

A connector (11) includes a plate-like housing (13) and crimp terminals (15) having crimping portions (20) for crimping electric wires (14) respectively. The housing (13) is provided with terminal containing sections (16) in a form of a groove in which a plurality of the crimping portions (20) of the crimp terminals (15) are positioned rectilinearly along axes of the electric wires (14) to be contained, and a plurality of recesses (17) continued from the terminal containing sections (16). Each of the crimp terminals (15) has an engaging portion (21) which is integrally formed with the crimping portion (20) and adapted to be contained in the recess (17).

8 Claims, 3 Drawing Sheets

CONNECTOR

BACKGROUND OF THE INVENTION

1. Field of the Invention

The present invention relates to a connector having crimp terminals, and more particularly to the connector provided with a plate-like housing and the crimp terminals.

2. Description of the Related Art

Conventionally, various types of crimp connectors provided with crimp terminals for connecting electric wires by crimping, and a housing for containing the crimp terminals have been proposed.

FIG. 5 shows one example of the conventional crimp connectors. In FIG. 5, a crimp connector 1 includes a housing 2 made of synthetic resin and a plurality of crimp terminals 3 (only one is shown in FIG. 5) to which electric wires 4 are respectively connected by crimping. The housing 2 has a plurality of terminal containing sections 5 in a shape of a groove which are arranged in parallel to each other and extend in a longitudinal direction of the housing 2. At a back side of the housing 2, there is formed an open part 6 through which the electric wires 4 are connected by crimping. A mating connector which is not shown is adapted to be connected to the crimp connector 1 by way of a front end of the housing 2.

The crimp terminal 3 is manufactured of an electrically conductive metal sheet by stamping with a press and includes an electric contact portion 7 in a rectangular box-like shape and a crimping portion 8 integrally formed with the electric contact portion 7. The crimping portion 8 has a pair of upright walls opposed to each other, and a pair of crimping edges 9, 9 are formed by bending the upright walls. An electric wire 4 is crimped between the crimping edges 9, 9 so that the crimp terminal 3 and the electric wire 4 can be electrically connected.

In the above described prior art, in order to join some of the plurality of the crimp terminals 3 which are juxtaposed in the housing 2, it has been accustomed that the electric wires 4 are folded in a U-shape as shown in FIG. 6, and both ends of the wires are connected to the crimping portions 8, 8 of the corresponding crimp terminals 3, 3 by crimping. However, conducting such connecting works at an end of a wire harness has been very annoying, and productivity of the wire harness has been badly affected.

Moreover, in the above described structure of the crimp connector 1, it has been impossible to join three or more crimp terminals 3 by the electric wire 4 at a time. Therefore, there has been such a problem that number of circuits to be produced would be restricted. Needless to say, marketability of the crimp connector 1 will be deteriorated with the restricted number of the circuits.

The present invention has been made in view of the above described circumstances, and it is an object of the invention to provide a connector which can attain improved productivity of the wire harness and increase in number of the joints between the crimp terminals.

SUMMARY OF THE INVENTION

In order to solve the above described problems, according to one aspect of the present invention, there is provided a connector comprising an insulating housing in a plate-like shape and a plurality of crimp terminals respectively having crimping portions for crimping electric wires, wherein the housing is provided with terminal containing sections in a form of a groove in which a plurality of the crimping portions are adapted to be positioned rectilinearly along axes of the electric wires to be contained, and a plurality of recesses continued from the terminal containing sections in a direction intersecting an extending direction of the terminal containing sections, and each of the crimp terminals includes an engaging portion which is integrally formed with the crimping portion in a direction intersecting an extending direction of the crimping portion and adapted to be contained in the recess to be electrically connected to a mating terminal.

According to another aspect of the present invention, at least three of the recesses are continued from each of the terminal containing sections.

According to the first aspect of the present invention, joints between the plurality of the crimp terminals can be conducted rectilinearly owing to arrangement of the terminal containing sections and the recesses in the housing, and arrangement of the crimping portion and the engaging portion of the crimp terminal. More circuits than before can be thus manufactured by joining a required number of the terminals.

According to the second aspect of the present invention, the joints among at least three crimp terminals can be rectilinearly conducted.

DESCRIPTION OF THE PREFERRED EMBODIMENTS

Figure 1:
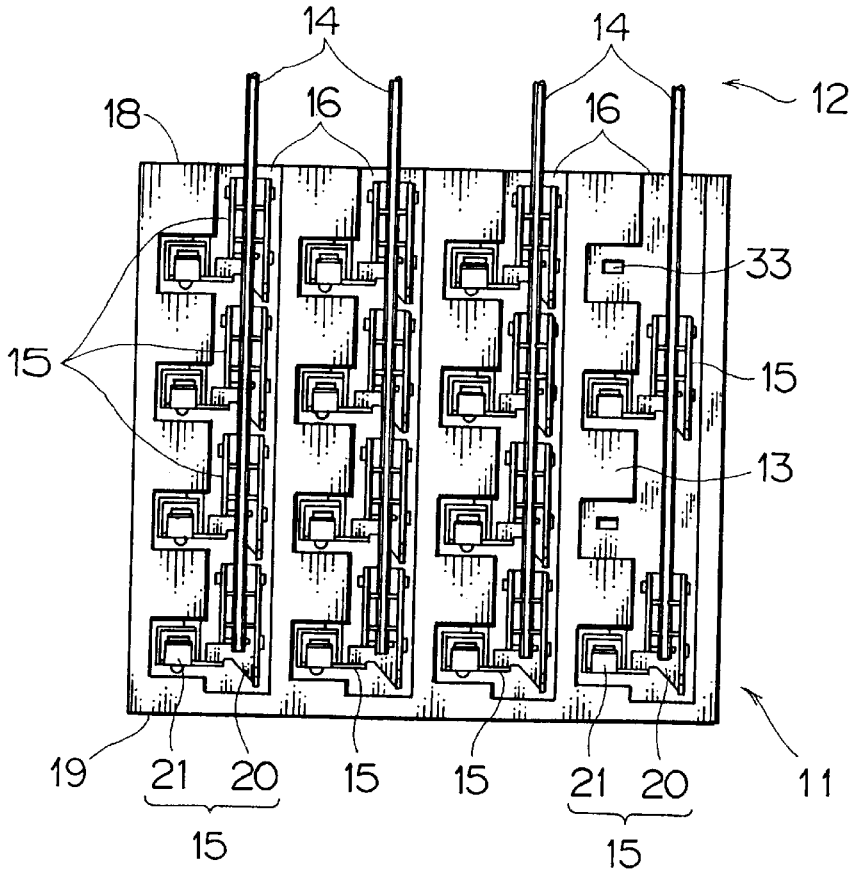
FIG. 1 is a plan view of one embodiment of a connector according to the present invention.
Figure 6:
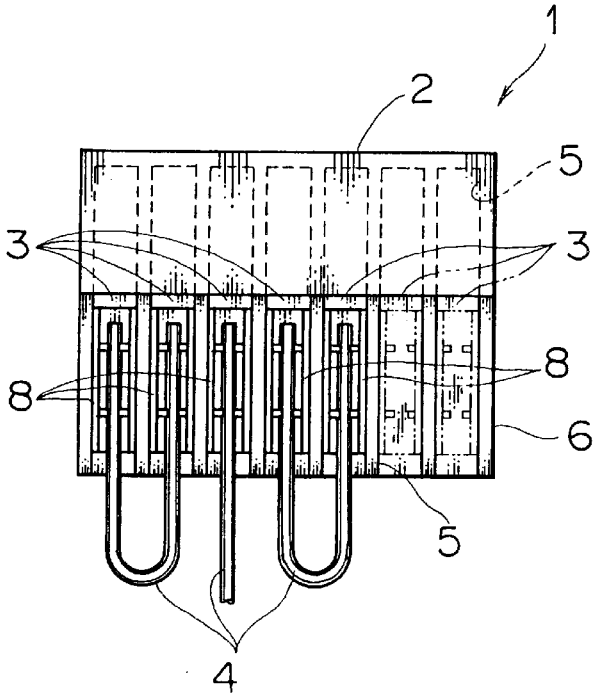
PRIOR ART FIG. 6
FIG. 6 is a plan view of the conventional crimp connector.

Now, one embodiment of the present invention will be described referring to the drawings.

In FIG. 1, a connector which is represented by reference numeral 11 is attached to a terminal end of a wire harness 12, for example, and includes a plate-like housing 13 and a plurality of crimp terminals 15 to which electric wires 14 are connected by crimping. The connector 11 is constructed in such a manner that productivity of the wire harness 12 can be improved and joints between the plurality of the crimp terminals 15 can be increased in number. It is to be noted that the connector 11 may be called as a plate connector or a crimp connector in some cases.

Figure 2:
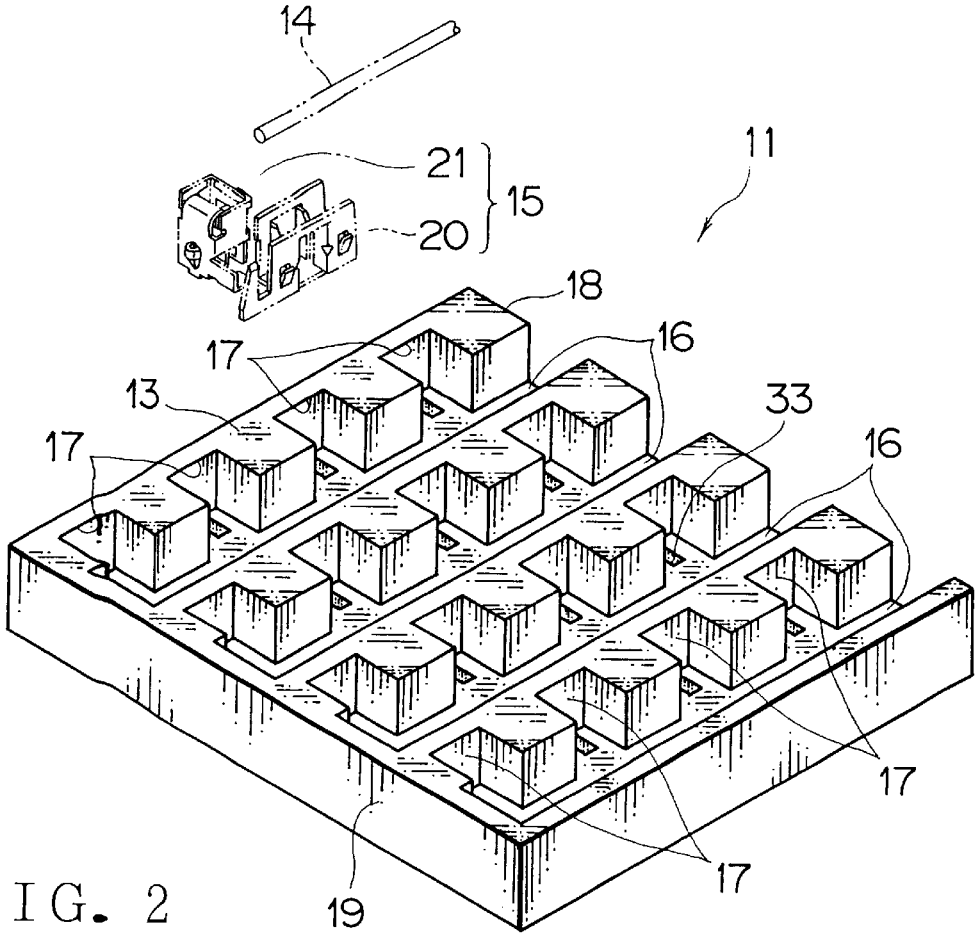
FIG. 2 is an exploded perspective view of the connector of FIG. 1.

The housing 13 is molded of insulating synthetic resin, and in this embodiment, formed in a rectangular shape as seen in a plan view. The housing 13 has four (not limited to this number) terminal containing sections 16 as shown in FIGS. 1 and 2. Each of the terminal containing sections 16 are provided with four (not limited to this number, but preferably three or more) recesses 17 continued therefrom. There are formed through holes 33 for passing the terminals in bottom walls of the respective recesses 17.

The terminal containing section 16 extends in a shape of a groove from one end 18 of the housing 13 to a position near the other end 19 opposite to the one end 18. The containing section 16 is formed in a C-shape in cross section and extends rectilinearly.

A width of the groove of the containing section 16 (in a direction intersecting the extending direction of the containing section 16) corresponds to a width of a below-mentioned crimping portion 20 of the crimp terminal 15. A depth of the groove of the containing section 16 is so set that the crimp terminal 15 can be just concealed.

The recess 17 is intended to receive a below mentioned engaging portion 21 of the crimp terminal 15 and formed in a direction intersecting the extending direction of the containing section 16. The four recesses 17 continued from each of the containing section 16 are formed at an equal pitch in the above mentioned extending direction and have a same depth as the depth of the groove of the containing section 16. The four recesses 17 are formed at left hand of each of the containing sections 16 in this embodiment, as seen in a plan view of FIG. 1. The containing sections 16 are arranged in parallel to each other in the aforesaid intersecting direction, and the four recesses 17 are spaced from the adjacent containing section 16.

Figure 3:
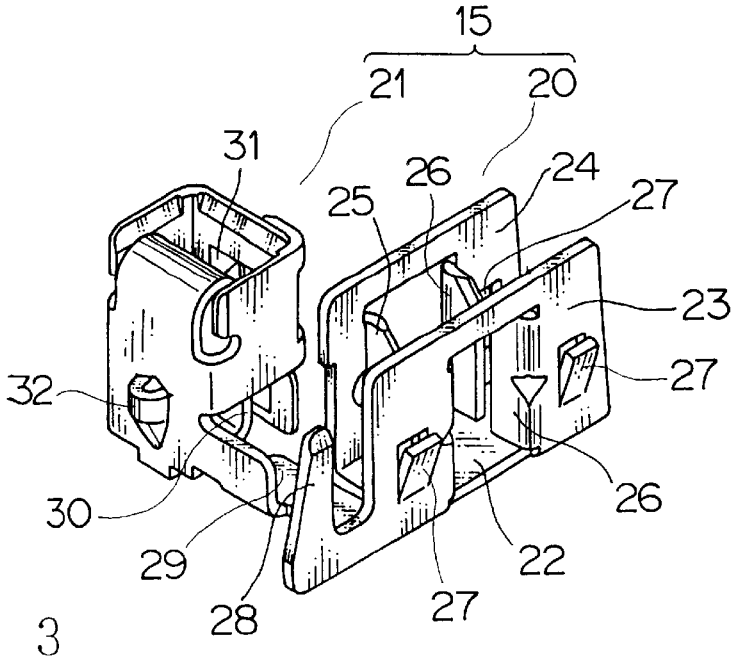
FIG. 3 is a perspective view of a terminal of FIG. 1.
Figure 4:
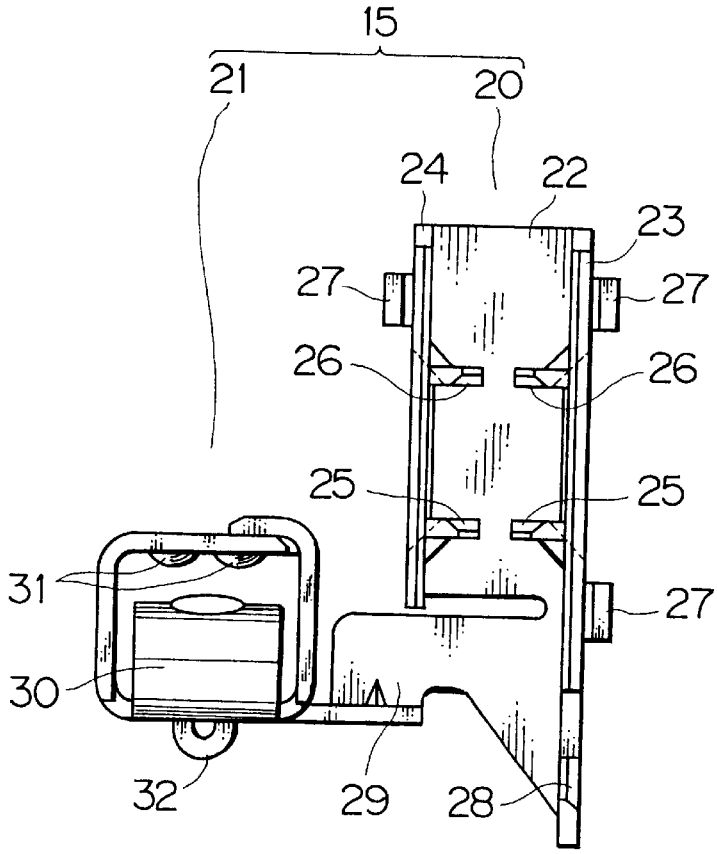
FIG. 4 is a plan view of the terminal of FIG. 1.
Figure 5:
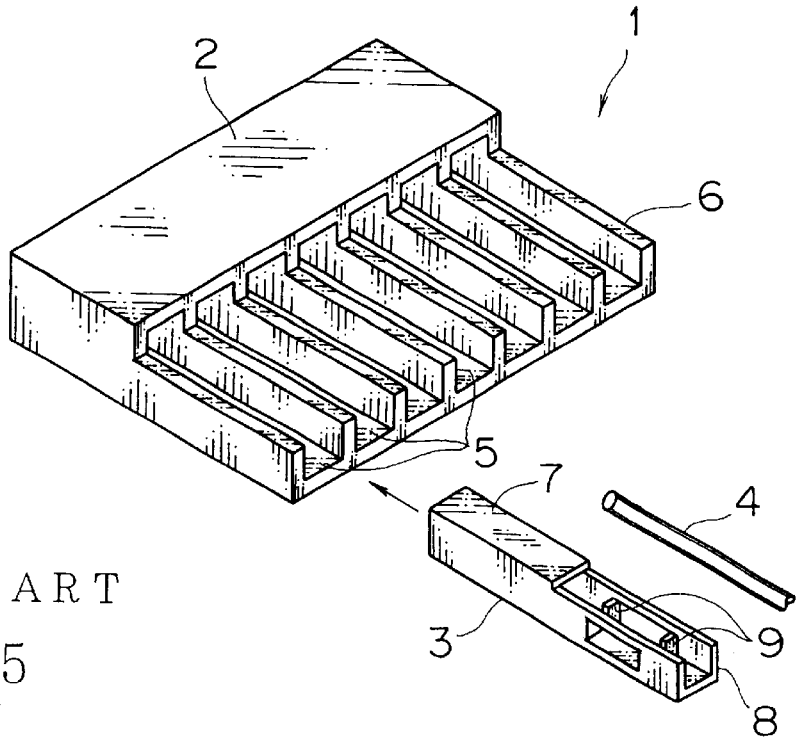
PRIOR ART FIG. 5
FIG. 5 is an exploded perspective view of a conventional crimp connector.

The crimp terminal 15 which is manufactured of a conductive metal sheet by stamping with a press, includes the crimping portion 20 for crimping the electric wire 14 (see FIG. 2) and the engaging portion 21 which serves as an electric connection with a mating connector which is not shown, as seen in FIGS. 3 and 4. The mating terminal which is not shown is inserted into the recess 17 from below through the through hole 33. Alternatively, the mating terminal may be inserted into the recess 17 from above so that a distal end thereof is seated in the through hole 33.

The crimping portion 20 is adapted to be contained in the containing section 16 and to crimp the electric wire 14. The crimping portion 20 has a base plate 22 and side walls 23, 24 which are upright on both sides of the base plate 22. The base plate 22 is flat and designed so as to be positioned along a bottom of the containing section 16. The side walls 23, 24 are designed so as to be positioned along both side walls of the containing section 16. In other words, the side wall 23 is arranged so as to be positioned along the right side wall of the containing section 16 while the side wall 24 is arranged so as to be positioned along the left side wall of the containing section 16.

The side wall 23 is provided with crimping edges 25, 26, flexible locking pieces 27, 27 and a wire caulking piece 28. The crimping edges 25, 26 are formed by cutting out the side wall 23 so as to project inwardly in a direction intersecting the side wall 23, with their tip ends directed toward the side wall 24. The flexible locking pieces 27, 27 have resiliency and are bent outward from a base end part of the side wall 23. Tip ends of the flexible locking pieces 27, 27 are adapted to slidably contact with the side wall of the containing section 16. The flexible locking pieces 27, 27 are arranged on both sides of the crimping edges 25 and 26 in a longitudinal direction. The wire caulking piece 28 is provided in the engaging portion 21. The electric wire 14 which has been crimped can be held by the wire caulking piece 28.

The side wall 24 is also provided with the crimping edges 25, 26 and the flexible locking piece 27. Tip ends of the crimping edges 25, 26 of the side wall 24 are opposed to the tip ends of the crimping edges 25, 26 of the side wall 23 with a determined distance therebetween. Both the crimping edges 25 of the side walls 23 and 24 are formed in pairs and both the crimping edges 26 of the side walls 23 and 24 are formed in pairs in the same manner. The flexible locking piece 27 of the side wall 24 is formed at a position remote from the engaging portion 21. A tip end of the flexible locking piece 27 is adapted to slidably contact with the side wall of the containing section 16. The flexible locking pieces 27 of the side walls 23, 24 function as retaining means for the terminal from the containing section 16.

The engaging portion 21 is integrally formed with the crimping portion 20 by way of a connecting portion 29 which is continued from the base plate 22 in the aforesaid intersecting direction (at the left hand in a plan view of FIG. 1). The engaging portion 21 is formed in a box-like shape by bending the same metal sheet and includes therein an elastic contact piece 30 having resiliency. The elastic contact piece 30 is formed by bending a part of the engaging portion 21, and adapted to elastically contact with a tab of the aforesaid mating terminal (not shown) for example. Projections 31 are formed at positions opposed to the elastic contact piece 30 so as to clamp the tab in cooperation with the elastic contact piece 30. Reference numeral 32 represents a retaining projection with respect to the recess 17 (See FIG. 2).

In the above described structure, the connector 11 is assembled by disposing and fitting the plurality of the crimp terminals 15 at the determined positions in the housing 13 and crimping the electric wires 14 to the terminals 15 respectively. In this embodiment, the four crimping portions 20 are respectively arranged rectilinearly in the three containing sections 16 from the left (a plurality of the crimping portions 20 are positioned rectilinearly along axes of the contained electric wires 14), and joined together. The two crimping portions 20 are arranged rectilinearly at every other position in the rightmost containing section 16 of the housing 13, and joined together. Since the electric wires 14 are contained rectilinearly and crimped, productivity of the wire harness 12 will be no doubt enhanced. In addition, the number of the joints between the crimp terminals 15 will be increased more than before (The number of the joints will be increased more than before if at least three crimp terminals 15 are connected). Further, because more circuits can be manufactured than before, flexibility of the connector will be enhanced, and marketability will be improved.

It is apparent that various modifications can be made without changing the gist of the present invention. Specifically, the housing provided with much more containing sections 16 and recesses 17 can be employed.

What is claimed is:

1. A plate connector to be electrically connected to a mating connector and comprising an integral, one-piece insulating housing and a plurality of crimp terminals further comprising respective crimping portions for crimping electric wires, wherein said housing includes crimp terminal containing sections;

each of the sections being in a form of a groove, in which a plurality of said crimping portions are adapted to be positioned rectilinearly along axes of said electric wires to be contained therein, and each including a plurality of recesses extending from said crimp terminal containing sections in a direction intersecting an extending direction of said crimp terminal containing sections, and each of said crimp terminals includes an engaging portion which is integrally formed with said crimping portion in a direction intersecting an extending direction of said crimping portion and adapted to be contained in said recess to be electrically connected to the mating terminal.

2. The connector as claimed in claim 1, wherein at least three of said recesses extend from each of said crimp terminal containing sections.

3. The connector as claimed in claim 1, wherein the crimp terminals are disposed below a surface of the housing.

4. The connector as claimed in claim 1, wherein the crimp-terminal-containing sections in the form of a groove are mutually parallel and are on one side of the housing.

5. The connector as claimed in claim 1, wherein the housing is rectangular.

6. The connector as claimed in claim 1, wherein the housing includes a substantially flat surface into which are formed the crimp terminal containing sections and the recesses.

7. The connector as claimed in claim 6, wherein the housing includes a back surface generally parallel to the flat surface.

8. The connector as claimed in claim 7, wherein the crimp terminals are below the flat surface.

* * * * *